US012369716B1

(12) United States Patent
Zhang

(10) Patent No.: US 12,369,716 B1
(45) Date of Patent: Jul. 29, 2025

(54) MAGNETICALLY ATTRACTED CHAIR PILLOW INSERT AND CHAIR

(71) Applicant: Anji Leisa Furniture Co., Ltd., Zhejiang (CN)

(72) Inventor: Lianchen Zhang, Zhejiang (CN)

(73) Assignee: Anji Leisa Furniture Co., Ltd., Zhejiang (CN)

( * ) Notice: Subject to any disclaimer, the term of this patent is extended or adjusted under 35 U.S.C. 154(b) by 0 days.

(21) Appl. No.: 19/079,586

(22) Filed: Mar. 14, 2025

(30) Foreign Application Priority Data

Mar. 14, 2024 (CN) ..... 202420495061.9

(51) Int. Cl.
*A47C 7/38* (2006.01)

(52) U.S. Cl.
CPC ..... *A47C 7/383* (2013.01)

(58) Field of Classification Search
CPC ..... A47C 7/383; A47C 7/36; A47C 7/38
USPC ..... 297/397, 394
See application file for complete search history.

(56) References Cited

U.S. PATENT DOCUMENTS 6,149,234 A * 11/2000 Daniels ..... A47C 31/11 297/229
6,748,615 B1 * 6/2004 Tiedemann ..... A47C 7/383 5/636
D531,424 S * 11/2006 Kusachi ..... D6/367
8,033,603 B2 * 10/2011 Meert ..... B60N 2/80 297/216.12
8,708,416 B2 * 4/2014 Stronconi ..... A47C 7/383 297/397
11,297,961 B2 * 4/2022 Lowry ..... A47G 9/1027
2001/0022457 A1 * 9/2001 Voris ..... B60N 2/2851 297/219.12
2001/0049844 A1 * 12/2001 Gilbert ..... A47C 7/425 5/636
2011/0204696 A1 * 8/2011 Koehler ..... A42B 1/24 297/464
2020/0022510 A1 * 1/2020 Shokrian ..... A47G 9/0253
2020/0077820 A1 * 3/2020 Lowry ..... A47G 9/1027

* cited by examiner

*Primary Examiner* — Shin H Kim
(74) *Attorney, Agent, or Firm* — Hawaii Patent Services; Nathaniel K. Fedde; Kenton N. Fedde

(57) ABSTRACT

The present disclosure provides a magnetically attracted chair pillow insert and a chair comprising a magnetically attracted chair pillow insert. The magnetically attracted chair pillow insert comprises a pillow insert body and a magnetic block. The magnetically attracted chair pillow insert further comprises a magnetic block fixing component. The magnetic block is fixed to the magnetic block fixing component through an elastic expansion mechanism. The magnetic block fixing component is fixed to the pillow insert body. The magnetic block fixing component includes a main body plate, and the elastic expansion mechanism includes a positioning post with one end connected to the main body plate.

16 Claims, 3 Drawing Sheets

MAGNETICALLY ATTRACTED CHAIR PILLOW INSERT AND CHAIR

CROSS-REFERENCE TO RELATED APPLICATIONS

This application claims priority to the Chinese patent application No. 202420495061.9, titled "magnetically attracted chair pillow insert and Chair" filed on Mar. 14, 2024, the entire content of which, including the amendment, is incorporated into this application herein by reference in its entirety.

TECHNICAL FIELD

The present disclosure relates to the technical field of chair headrests, and particularly to a magnetically attracted chair pillow insert and a chair.

BACKGROUND

Existing chairs usually have a headrest for the head and neck to lean on. The function of the headrest is to support the neck and relieve neck fatigue caused by sitting in one position for a long time. When the sitting posture is incorrect or the same posture is maintained for a long time, the neck is prone to bear excessive pressure, and the headrest can effectively disperse this pressure and provide necessary support for the neck.

CN US201922232690.4 discloses an adsorbable headrest. In this patent, a metal sheet is bonded to the side surface of the chair, and a magnet sheet is fixed to the side surface of the headrest body with glue. Then, the headrest is fixed to the chair body by the way that the magnet sheet adsorbs the metal sheet. However, the method of fixing the magnet sheet with glue has the following problems: first, the glue needs a curing period, resulting in a long production cycle; second, there is a hidden danger of the glue falling off, and the design is unreasonable.

Therefore, there is a need to propose a new type of headrest to solve the above-mentioned problems.

SUMMARY

The present disclosure provides a magnetically attracted chair pillow insert and a chair to solve the problems raised in the above background art.

In order to achieve the above-mentioned object of the invention, the present disclosure adopts the following technical solutions:

The present disclosure provides a magnetically attracted chair pillow insert, which includes a pillow insert body and a magnetic block, wherein the magnetically attracted chair pillow insert further includes a magnetic block fixing component, the magnetic block is fixed to the magnetic block fixing component through an elastic expansion mechanism, and the magnetic block fixing component is fixed to the pillow insert body; and the magnetic block fixing component includes a main body plat, and the elastic expansion mechanism includes a positioning post with one end connected to the main body plate; and a cutting groove that divides at least part of the positioning post into several elastic expansion arms is provided on the positioning post, the elastic expansion arms extend into the magnetic block, and an elastic force released by the elastic expansion arms fixes the magnetic block.

The present disclosure further provides a chair, which includes a chair body and a magnetically attracted chair pillow insert detachably installed on the chair body, wherein the magnetically attracted chair pillow insert includes a pillow insert body, a magnetic block, and a magnetic block fixing component fixed on the pillow insert body, wherein the magnetic block fixing component includes a main body plate; and the magnetic block is fixed on the magnetic block fixing component through an elastic expansion mechanism, wherein the elastic expansion mechanism includes a positioning post with one end connected to the main body plate; and the positioning post is provided with a cutting groove that divides at least part of the positioning post into a plurality of elastic expansion arms, the elastic expansion arms extend into the magnetic block, and an elastic force released by the elastic expansion arms fixes the magnetic block.

BRIEF DESCRIPTION OF DRAWINGS

The drawings, which form a part of this application, are used to provide a further understanding of the present disclosure. The schematic embodiments of the present disclosure and the descriptions thereof are used to explain the present disclosure and do not constitute an improper limitation of the present disclosure. In the drawings.

Figure 1:
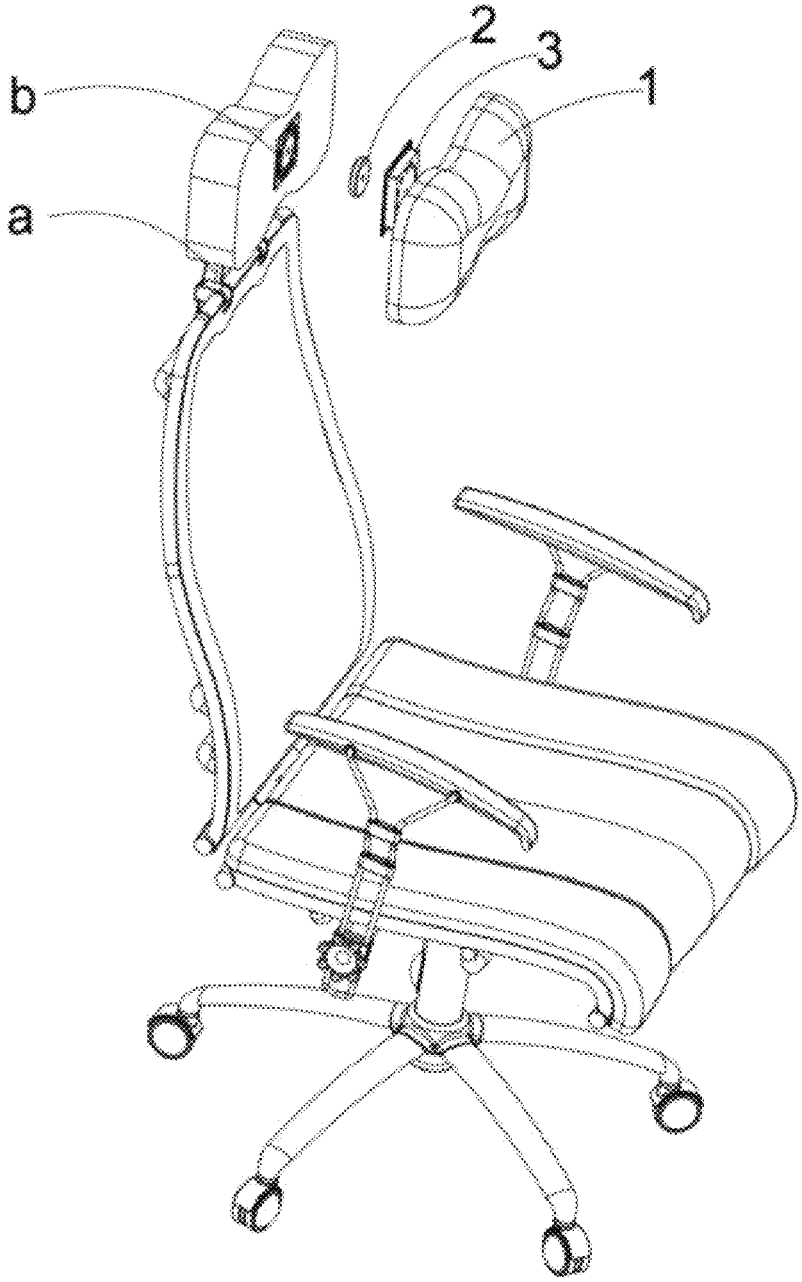
FIG. 1 is a schematic diagram of the magnetically attracted chair pillow insert of the present disclosure installed on a chair.

Reference signs: pillow insert body (1); Magnetic block (2); Mounting hole (21); Magnetic block fixing component (3); Main body plate (31); Positioning post (32); Elastic expansion arm (33); Anti-detachment protrusion (4); First annular cylinder (5); Second annular cylinder (6); Reinforcement protrusion (7); Through port (8); Skirt edge (9); Through hole (91); Chair body (a); Magnetic component (b).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

Embodiment 1

As shown in FIGS. 1 to 4, a magnetically attracted chair pillow insert includes a pillow insert body 1 and a magnetic block 2. The magnetically attracted chair pillow insert also includes a magnetic block fixing component 3. The magnetic block 2 is fixed on the magnetic block fixing component 3 through an elastic expansion mechanism, and the magnetic block fixing component 3 is fixed on the pillow insert body 1.

Specifically, the magnetic block 2 is a strong magnetic block. The magnetically attracted chair pillow insert can be a headrest or a lumbar pillow. More specifically, the magnetic block fixing component 3 is made of a plastic material. The pillow insert body 1 is injection-molded from a foam material and embeds the magnetic block fixing component 3 to ensure the connection stability between them and achieve a good magnetic attraction effect at the same time.

Figure 2:
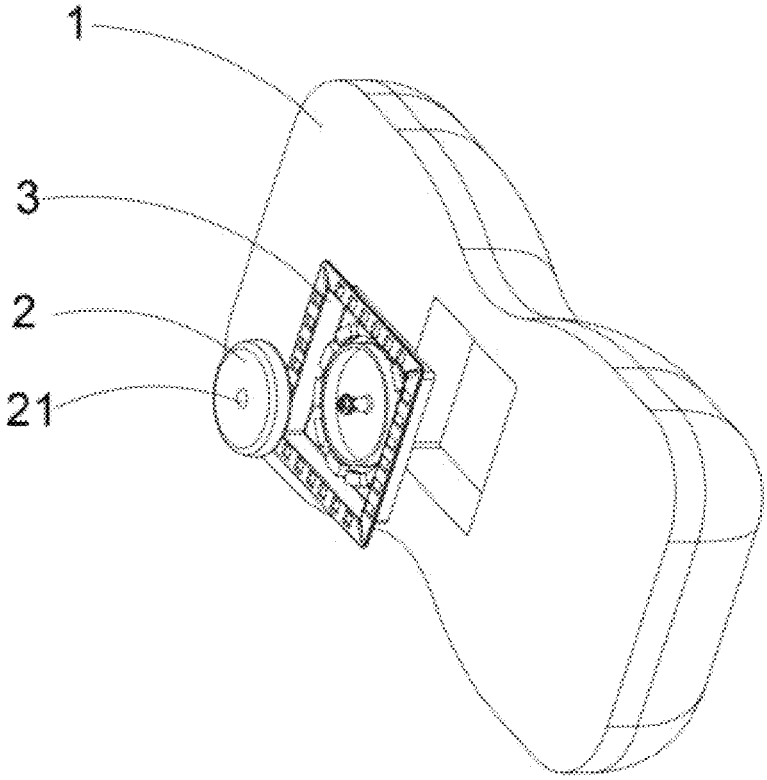
FIG. 2 is a schematic structural diagram of the magnetically attracted chair pillow insert of the present disclosure.

To fix the magnetic block 2 well, as shown in FIGS. 1 and 2, the magnetic block 2 is annular, and the elastic expansion mechanism is an internal elastic expansion mechanism that extends into the magnetic block 2 and expands outward. This ensures the fixing stability of the magnetic block 2 and at the same time avoids the displacement of the magnetic block 2 installed in the magnetic block fixing component 3.

Figure 3:
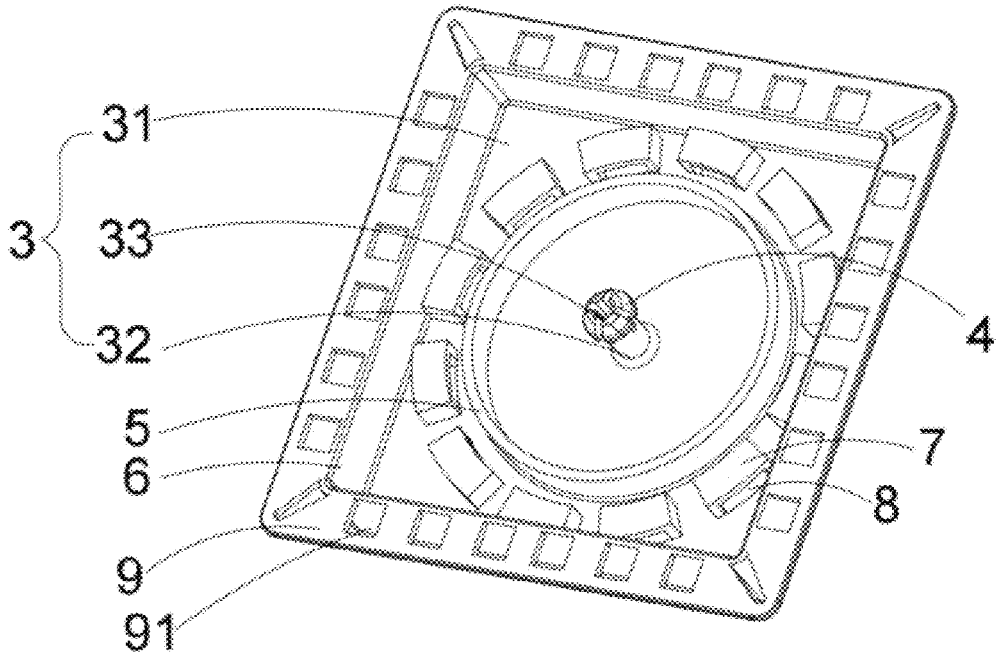
FIG. 3 is a schematic diagram of a partial structure in FIG. 2.
Figure 4:
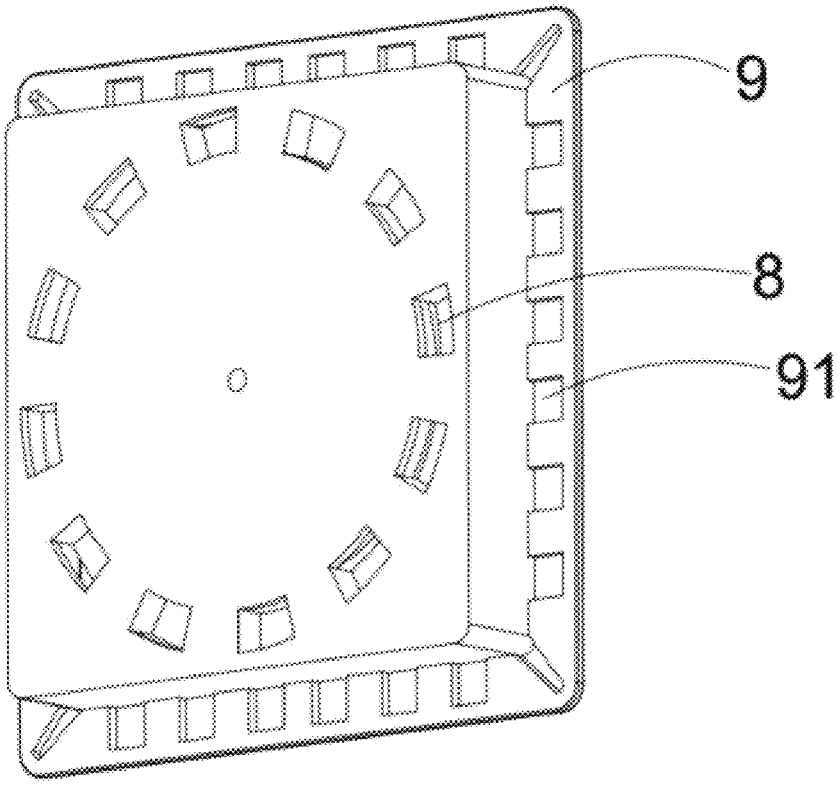
FIG. 4 is a schematic structural diagram from another perspective in FIG. 3.

To fix the magnetic block 2 by the elastic expansion of the magnetic block fixing component 3, as shown in FIGS. 1 to 3, the magnetic block fixing component 3 includes a main body plate 31. The elastic expansion mechanism includes a positioning post 32 connected to the main body plate 31 at one end. The positioning post 32 is provided with a cutting groove that divides at least part of the positioning post 32 into several elastic expansion arms 33. The elastic expansion arms 33 extend into the magnetic block 2, and the elastic force released by the elastic expansion arms 33 fixes the magnetic block 2.

To prevent the magnetic block 2 installed in the elastic expansion arm 33 from detaching, as shown in FIGS. 1 to 4, an anti-detachment protrusion 4 is provided at one end of at least one elastic expansion arm 33 away from the main body plate 31. The anti-detachment protrusion 4 is used to prevent the magnetic block 2 from detaching from the elastic expansion arm 33. Specifically, in this embodiment, the anti-detachment protrusion 4 is a conical block protruding outward at the end of the elastic expansion arm 33. A mounting hole 21 is provided through the center of the magnetic block 2. When the magnetic block 2 is inserted into the elastic expansion arm 33 through one end of the mounting hole 21 and extends into the positioning post 32, the elastic expansion arm 33 extends out from the other end of the mounting hole 21 and releases the elastic force, allowing the anti-detachment protrusion 4 to expand outward to prevent the magnetic block 2 from detaching.

To facilitate the accommodation of the magnetic block 2, specifically, in this embodiment, the side of the main body plate 31 where the positioning post 32 is provided also has a first annular cylinder 5 for accommodating the magnetic block 2. The first annular cylinder 5 is any one of a circular cylinder, a triangular cylinder, and a rectangular cylinder. More specifically, the outer edge of the main body plate 31 is provided with a second annular cylinder 6. The outer wall of the first annular cylinder 5, the main body plate 31, and the inner wall of the second annular cylinder 6 form an annular filling space.

To achieve a good connection of the magnetic block fixing component 3. As shown in FIGS. 1 to 4, several reinforcement protrusions 7 are provided on the main body plate 31 in the annular filling space. A through port 8 is provided at a joint between each reinforcement protrusion 7 and the main body plate 31, and the through port 8 is in communication with the annular filling space. In this embodiment, a skirt edge 9 extending radially outward is provided at one end of the second annular cylinder 6 away from the main body plate 31, and several through holes 91 are provided on the skirt edge 9.

By providing reinforcement protrusions 7, the through ports 8, and the through holes 91 on the magnetic block fixing component 3, when the pillow insert body 1 is injection-molded, the liquid foam material will flow into the reinforcement protrusions 7, the through holes 91, and the annular filling space. Thus, after the pillow insert body 1 is solidified, the magnetic block fixing component 3 can be more stably installed on the pillow insert body 1.

In other embodiments (not shown), in order to improve the connection stability between the magnetic block fixing component 3 and the pillow insert body 1, the surface of the magnetic block fixing component 3 can also be provided with uneven patterns. Thus, when the pillow insert body 1 is injection-molded, the contact area with the magnetic block fixing component 3 can be increased, further improving the connection stability.

Embodiment 2

As shown in FIGS. 1 to 4, the present disclosure also provides a chair, which includes a chair body a. A magnetic component b is provided on the chair body a. The chair also includes the magnetically attracted chair pillow insert of the above-mentioned Embodiment 1. The magnetic block 2 of the magnetically attracted chair pillow insert is magnetically attracted to the magnetic component b. Thus, the magnetically attracted chair pillow insert can be adsorbed on the chair body a.

In summary, from the above description, it can be seen that the present disclosure achieves the following technical effects:

The present disclosure can ensure the firm installation of the headrest and, at the same time, avoid the potential risk of detachment caused by unstable fixation. The magnetic block fixing component 3 has an elastic expansion mechanism, through which the magnetic block 2 is fixed on the magnetic block fixing component 3. The magnetic block fixing component 3 is hidden in the pillow insert body 1, and the pillow insert body 1 is magnetically fixed to the chair through the magnetic block 2.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A magnetically attracted chair pillow insert, comprising a pillow insert body and a magnetic block, wherein the magnetically attracted chair pillow insert further comprises a magnetic block fixing component, the magnetic block is fixed to the magnetic block fixing component through an elastic expansion mechanism, and the magnetic block fixing component is fixed to the pillow insert body; and the magnetic block fixing component comprises a main body plat, and the elastic expansion mechanism comprises a positioning post with one end connected to the main body plate; and a cutting groove that divides at least part of the positioning post into several elastic expansion arms is provided on the positioning post, the elastic expansion arms extend into the magnetic block, and an elastic force released by the elastic expansion arms fixes the magnetic block.

2. The magnetically attracted chair pillow insert according to claim 1, wherein the magnetic block is annular, and the elastic expansion mechanism is an internal elastic expansion mechanism that extends into the magnetic block and expands outward.

3. The magnetically attracted chair pillow insert according to claim 1, wherein at least one end of the elastic expansion arm away from the main body plate is provided with an anti-detachment protrusion that is configured to prevent the magnetic block from detaching from the elastic expansion arm.

4. The magnetically attracted chair pillow insert according to claim 1, wherein a side of the main body plate where the positioning post is provided is further equipped a first annular cylinder for accommodating the magnetic block.

5. The magnetically attracted chair pillow insert according to claim 4, wherein the pillow insert body is injection-molded from a foam material and embeds the magnetic block fixing component.

6. The magnetically attracted chair pillow insert according to claim 5, wherein an outer edge of the main body plate is provided with a second annular cylinder, and an annular filling space is formed by an outer wall of the first annular cylinder, the main body plate, and an inner wall of the second annular cylinder for filling with the foam material.

7. The magnetically attracted chair pillow insert according to claim 6, wherein the main body plate is provided with a plurality of reinforcement protrusions in the annular filling space, and a through port is provided at a joint between each reinforcement protrusion and the main body plate, wherein the through port is in communication with the annular filling space and is configured for filling with the foaming material.

8. The magnetically attracted chair pillow insert according to claim 6, wherein one end of the second annular cylinder away from the main body plate is provided with a skirt edge extending radially outward, and the skirt edge is provided with a plurality of through holes for filling with the foaming material.

9. A chair, comprising a chair body and a magnetically attracted chair pillow insert detachably mounted on the chair body, wherein the magnetically attracted chair pillow insert comprises a pillow insert body, a magnetic block, and a magnetic block fixing component fixed on the pillow insert body, wherein the magnetic block fixing component comprises a main body plate; and the magnetic block is fixed on the magnetic block fixing component through an elastic expansion mechanism, wherein the elastic expansion mechanism comprises a positioning post with one end connected to the main body plate; and the positioning post is provided with a cutting groove that divides at least part of the positioning post into a plurality of elastic expansion arms, the elastic expansion arms extend into the magnetic block, and an elastic force released by the elastic expansion arms fixes the magnetic block.

10. The chair according to claim 9, wherein the chair body is provided with a magnetic component, and the magnetic block attracts the magnetic component.

11. The chair according to claim 9, wherein at least one end of the elastic expansion arm away from the main body plate is provided with an anti-detachment protrusion that is configured to prevent the magnetic block from detaching from the elastic expansion arm.

12. The chair according to claim 9, wherein the magnetic block is annular, and the elastic expansion mechanism is an internal elastic expansion mechanism that extends into the magnetic block and expands outward.

13. The chair according to claim 9, wherein the pillow insert body is injection-molded from a foaming material and embeds the magnetic block fixing component; and a side of the main body plate provided with the positioning post is further equipped with a first annular cylinder for accommodating the magnetic block.

14. The chair according to claim 13, wherein an outer edge of the main body plate is provided with a second annular cylinder, wherein an outer wall of the first annular cylinder, the main body plate, and an inner wall of the second annular cylinder form an annular filling space for filling with the foaming material.

15. The chair according to claim 14, wherein the main body plate is provided with a plurality of reinforcement protrusions located in the annular filling space, and a through port is provided at a joint between each reinforcement protrusion and the main body plate, wherein the through port is in communication with the annular filling space and is configured for filling with the foaming material.

16. The chair according to claim 14, wherein one end of the second annular cylinder away from the main body plate is provided with a skirt edge extending radially outward, and the skirt edge is provided with a plurality of through holes for filling with the foaming material.

* * * * *